US005870873A

United States Patent [19]

Dahlin et al.

[11] Patent Number: 5,870,873

[45] Date of Patent: Feb. 16, 1999

[54] BORDER UNIT

[76] Inventors: Bo Dahlin, Drejarvägen 15, Södertälje, Sweden, 151 62; Peder Alén, Orrstigen 10, Södertälje, Sweden, 151 63; Tommy Pettersson, Åkersberg, Hölö, Sweden, 153 92

[21] Appl. No.: 813,634

[22] Filed: Mar. 7, 1997

[51] Int. Cl.[6] ..... E01F 13/00; E01F 15/00

[52] U.S. Cl. ..... 52/592.1; 404/6; 404/7; 52/578; 52/102; 256/13.1

[58] Field of Search ..... 52/102, 578, 586.1, 52/586.2, 588.1, 592.1, 592.3, 587.1, 604; 256/13.1; 472/92, 94; 404/6, 7

[56] References Cited

U.S. PATENT DOCUMENTS

| | | | |
|---|---|---|---|
| 1,115,542 | 11/1914 | Hudson | 52/592.1 X |
| 1,122,250 | 12/1914 | Brooks | 52/592.1 X |
| 4,113,400 | 9/1978 | Smith | 404/6 |
| 4,681,302 | 7/1987 | Thompson | 256/13.1 |
| 4,828,425 | 5/1989 | Duckett | 404/6 |
| 5,003,746 | 4/1991 | Wilston | 52/589 |
| 5,046,884 | 9/1991 | Girotti | 404/6 |
| 5,107,652 | 4/1992 | Sosa | 52/578 |
| 5,123,773 | 6/1992 | Yodock | 256/13.1 X |
| 5,205,090 | 4/1993 | Lavery | 52/102 |
| 5,464,306 | 11/1995 | Cristiano | 256/13.1 X |

FOREIGN PATENT DOCUMENTS

| | | | |
|---|---|---|---|
| 2264937 | 10/1975 | France | 52/592.1 |

*Primary Examiner*—Robert Canfield
*Attorney, Agent, or Firm*—Jacobson, Price, Holman & Stern, PLLC

[57] ABSTRACT

A border unit comprising a front panel (3) and a foot (4, 5) which when standing on a flat horizontal base surface supports the front panel (3) vertically with the bottom edge of the front panel (3) extending along the base surface. The unit (20) has end surfaces (21, 22) which are adapted to support each other around at least part of the cross section periferi of coaxially joined unit (20). Each unit (20) has at one end (22) a vertical rod (7) and at the other end (21) a recess which receives the rod (7) of an adjoining unit (20), to form a coupling (7, 11) for joining units. The coupling is located in a central part of the unit cross section; the end surfaces of the unit has a straight generatrice which is parallel to the rod and vertical when the unit stands on a horizontal base surface.

3 Claims, 1 Drawing Sheet

BORDER UNIT

BACKGROUND OF THE INVENTION

The present invention refers to a border unit.

The border unit is intended for building a border, particularly a temporary border.

Primarily, the border units are intended to form a border for a playfield, for example for in-line hockey or the like, but it should be clear, that the units could be used for establishing a border or edging for any purpose.

In particular, a playfield border can readily be established on and removed from any flat floor area or ground area, for example the ice of an icehockey rink.

A particular problem with borders of this type is that they on one hand must be easy to build and remove and on the other hand be stable in erected condition.

This and other objects are attained by the inventive border unit, which is defined in the appended claims, which form part of this specification.

SUMMARY OF THE INVENTION

Basically, the inventive border units comprise a front panel and a footing which supports the front panel perpendicularly to a flat base surface, with one of the parallel edges of the front panel adjacent to the base surface. The border units have a substantially constant exterior cross section contour along the length of the unit, and the units are adapted to be coaxially joined. The end surfaces of a unit are thus complementary and joined end surfaces of two units support against each other around at least part of the circumference of the end surface. The units are mutually coupled by coupling means comprising a vertically oriented rod at one end of the border unit, and a recess at the other end of the unit, receiving the rod, when the joined border units abut each other. The coupling means is located in the central part of the border unit cross section area. Thus, when the border units are coupled to each other, there is virtually no gap between the front panels, and moreover, the coupling is stiff against bending.

In preferred embodiments, the border unit also comprises a generally horizontal top panel, one edge of which is joined to the top edge of the front panel. The other edge of the top panel is joined to the top edge of a rear panel, which slopes downwardly and away from the front panel. The bottom edge of the front panel and the rear panel could constitute the footing, but preferably, the lower edge portions of the front and rear panels have been bent towards each other to form a footing with large support surface. Anchor means such as spikes can be attached to the footing in order to anchor the border units against sliding on the base surface. A recess is made at each longitudinal end of the top panel so that an operator, who is building or removing a border, can manipulate a unit at establishing or releasing a coupling.

The generatrix of the end surface of the border units is vertical, so as to permit mutual vertical displacement of the border units.

BRIEF DESCRIPTION OF THE DRAWINGS

In the following, the invention will be described in the form of an exemplary embodiment with reference to the drawings.

DESCRIPTION OF THE PREFERRED EMBODIMENTS

Figure 1:
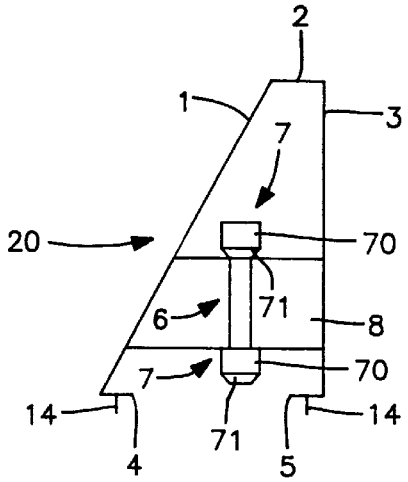
FIG. 1 shows an end view over one end of an inventive border unit.
Figure 2:
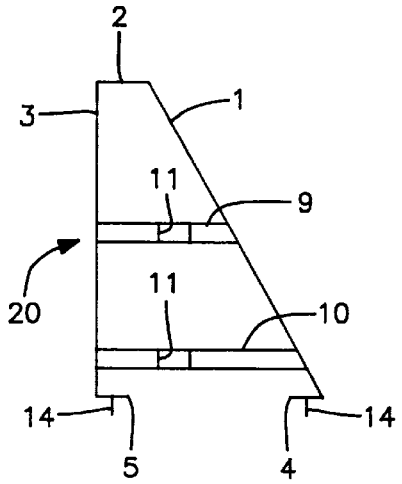
FIG. 2 shows an end view over the other end of the unit.
Figure 3:
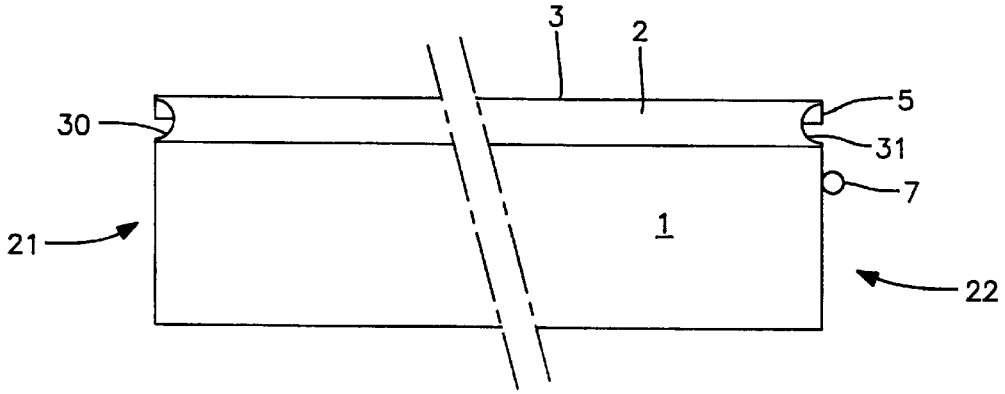
FIG. 3 shows a top view of the border unit.

With reference to FIGS. 1–3, the border unit 20 comprises a vertical front panel 3 intended to face the playfield, a generally horizontal top panel 2 and a sloping rear panel 1. The lower most rim portions 4, 5 of the rear panel 1 and front panel 3, respectively, have been bent towards each other to form a support footing with extended area for the border unit 20. On a flat horizontal base surface, the footings 4, 5 support the front panel 3 vertically, with the top and bottom edge of the front panel extending horizontally.

The panels 1, 2, 3 have a substantially constant cross sectional contour along the length of the border unit. At each of the unit ends 21, 22 the top panel 2 has a semi-circular recess 30, 31, which in the coupled condition of two units 20 form a circular opening, which can be covered with a lid or can constitute a seat for anchoring a super structure for the erected border.

The rear panel 1 facing the audience, can advantageously be used for carrying advertisements.

Figure 4:
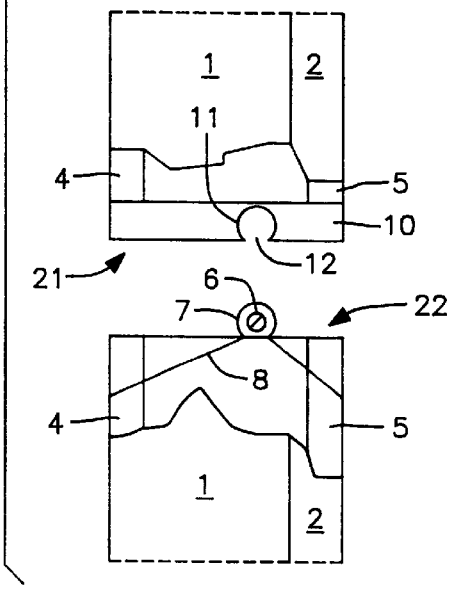
FIG. 4 shows a top view over two adjacent border units to be connected.

At the end 22 (FIG. 1) the border unit carries two coupling rods 7 which are formed at the ends of a vertical bar 6 which is supported by a bracket 8 that is joined to the front and rear panels 3, 1. The bracket 8 is angled in order to support the rods outside the end plane of the border unit. Said end plane is a normal plane to the longitudinal access of the border unit and is defined by the edges of the front and rear panels 3, 1. As can be seen in FIG. 4, the contour of the rod 7 intersects the end plane.

At the other end 21, there are cross bars 9, 10 each having a recess 11 which receives the rod 7 with a very close fit. The front edge of the cross bar lies in the end plane on the border unit and has a lateral entrance slot 12, the width of which is slightly larger than the diameter of the bar 6.

Each rod 7 has a head portion 70 which closely fits in the recess 11, and a tapered bottom portion 71 which simplifies the engagement of the rods in the recesses.

Figure 5:
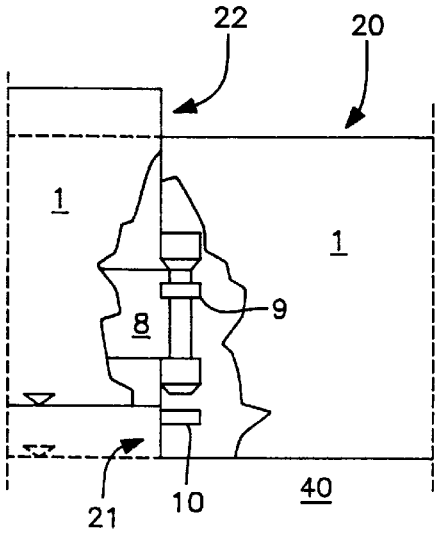
FIG. 5 illustrates two border units in engagement but before complete coupling.

As can be seen in FIG. 5, one unit 20 stands on the subsurface 40 and has its end surface 21 in engagement with the end surface 22 of the next unit, the rods of which are above and generally aligned with the recesses in the cross bars. After vertical parallel displacement of the left unit 40, the joining has been completed.

Various modifications are of course possible. For instance, the taper portion 71 of the rod 7 could be replaced by a tapered top portion of the recess 11 which extends vertically through the bar 9, 10.

Although the head portion 70 of the rod 7 has been shown as a circular cylinder, and the recess 11 has been shown as a corresponding vertical bore, the rod and the recess could of course take any other shapes.

The panels 1–5 of the border unit can be formed by bending a sheet metal plate, for example of aluminium. Alternatively, the panel structure of the border unit can be formed by extrusion of plastics material or a metal such as aluminium. The cross pieces 9, 10 and the bracket can be fastened by welding. The interior of the border unit can be filled with foam to support the panels and stiffen the border unit.

A border unit has preferably a height of 400 millimeters, and a base width of 295 millimeters, and the top panel has a width of 70 millimeters.

We claim:

1. A border unit for joining to other adjoining border units in a series of at least two to form a temporary border, said border unit comprising a front panel, a footing which when placed on a flat horizontal base surface supports said front panel substantially vertically with a bottom edge of said front panel extending along the base surface, said border unit having at least a first and second end each of which is adapted to connect to and support respectively a first and second adjoining border unit, said first end having spaced vertical rods adapted to be received by a recess on an end of the first adjoining border unit to form one coupling therebetween, said second end having spaced recesses each adapted to receive a rod on an end of said second adjoining border unit to form another coupling for said units, said first and second ends adapted to have said couplings located in a generally central portion of said ends, said ends adapted when coupled to have a generally straight generatrix that is generally parallel to said rod and generally vertical when said unit stands on said horizontal surface, said rods of said border unit being formed at the ends of a generally vertical bar.

2. The border unit according to claim 1, wherein said bar is supported by a bracket, the ends of which are joined to said front panel and a rear panel.

3. A border unit according to claim 1, wherein at least one of said rods has a lowered tapered portion.

* * * * *